US007897317B2

(12) United States Patent
Shinmura et al.

(10) Patent No.: US 7,897,317 B2
(45) Date of Patent: Mar. 1, 2011

(54) METHOD FOR PRODUCING CORE MATERIAL OF ELECTROPHOTOGRAPHIC FERRITE CARRIER AND RESIN-COATED FERRITE CARRIER

(75) Inventors: Issei Shinmura, Toride (JP); Kanao Kayamoto, Kamagaya (JP)

(73) Assignee: Powdertech Co., Ltd, Chiba (JP)

( * ) Notice: Subject to any disclaimer, the term of this patent is extended or adjusted under 35 U.S.C. 154(b) by 561 days.

(21) Appl. No.: 12/034,884

(22) Filed: Feb. 21, 2008

(65) Prior Publication Data

US 2008/0206664 A1 Aug. 28, 2008

(30) Foreign Application Priority Data

Feb. 28, 2007 (JP) ..... 2007-050163

(51) Int. Cl.
*G03G 9/087* (2006.01)

(52) U.S. Cl. ..... 430/137.1; 430/137.13

(58) Field of Classification Search ..... 430/137.1, 430/137.13

See application file for complete search history.

(56) References Cited

U.S. PATENT DOCUMENTS 5,419,994 A 5/1995 Honjo et al.

FOREIGN PATENT DOCUMENTS

JP 62-050839 A 3/1987
JP 3-233464 A 10/1991

OTHER PUBLICATIONS

English language Abstract of JP 3-233464 A.
English language Abstract of JP 62-050839 A.

*Primary Examiner*—Hoa V Le
(74) *Attorney, Agent, or Firm*—Greenblum & Bernstein, P.L.C.

(57) ABSTRACT

The present invention provides a method for producing a core material of an electrophotographic ferrite carrier, by charging a raw powder with an average particle size of 20 to 50 μm obtained by preparing raw materials for ferrite into a combustion flame along with a carrier gas for the raw powder, thermal-spraying the powder in atmospheric air to ferritize the powder, subsequently rapidly solidifying the thermal-sprayed particle, and sampling and collecting the particle, wherein the method satisfies the conditions comprising the following (1) to (3): (1) a mixture gas of propane and oxygen is used for the combustion flame for the thermal spraying, and a volumetric ratio of the propane to the oxygen is 1:3.5 to 6.0; (2) the carrier gas for the raw powder is air, nitrogen, oxygen or a mixture gas thereof, and the ratio (a/b) of a charged amount (a) of a raw powder (kg/hr) to a charged amount (b) of the carrier gas (kg/hr) for the raw powder is 4.8 or less; and (3) a flame flow velocity of the combustion flame is 65 to 125 m/sec.

6 Claims, No Drawings

METHOD FOR PRODUCING CORE MATERIAL OF ELECTROPHOTOGRAPHIC FERRITE CARRIER AND RESIN-COATED FERRITE CARRIER

TECHNICAL FIELD

The present invention relates to a method for producing a core material of an electrophotographic ferrite carrier and a resin-coated ferrite carrier which are used in an electrophotographic developer of a two-component system to be used in a copying machine, a printer and the like, and specifically relates to the method for producing the core material of the electrophotographic ferrite carrier which can economically and stably provide a resin-coated ferrite carrier that has superior fluidity, has slight variations in magnetization intensity, is highly magnetized and is spherical, and for producing the resin-coated ferrite carrier.

BACKGROUND ART

An electrophotography developing method is a method of making toner particles in a developer closely contact an electrostatic latent image formed on a photoreceptor to develop an image. The developer used therein is classified into a two-component type developer containing toner particles and carrier particles, and a one-component type developer using only toner particles.

A developing method using the two-component type developer containing the toner particles and the carrier particles out of the above developers has conventionally employed a cascade process or the like, but currently employs a magnetic brush process using a magnet roll in most cases.

In the two-component type developer, a carrier particle is a carrying substance which gives a desired charge to the toner particles by being stirred together with the toner particles in a developing box filled with the developer, further transports the toner particles charged in such a manner to the surface of the photoreceptor, and make the toner particles form a toner image on the photoreceptor. The carrier particles left on a developing roll which holds a magnet are returned from the developing roll into the developing box, are mixed/stirred with new toner particles, and are repeatedly used for a fixed period of time.

In contrast to a one-component type developer, the two-component type developer contains the carrier particles which have a function of electrically charging the toner particles and further transporting the toner particles by being mixed/stirred with the toner particles, and has excellent controllability when the developer is designed. Accordingly, the two-component type developer is suitable for a full-color developing apparatus which is required to have high image quality, and a high-speed printing apparatus or the like which is required to reliably keep an image and have durability.

The two-component type developer to be used in such a manner is required to show predetermined values of image characteristics such as an image density, fog, a white spot, a tone and a resolution from an early stage of printing, and to stably keep these characteristics constant during the durable printing period of time. In order to keep these characteristics stable, the two-component type developer needs to make the characteristics of the carrier particles contained therein stable.

As the carrier particles composing the two-component type developer, an iron powder carrier such as an iron powder having the surface covered with an oxide film or an iron powder having the surface coated with a resin has been conventionally used. Such an iron powder carrier is highly magnetized and also has high electroconductivity, and accordingly has an advantage of easily obtaining an image having excellent reproducibility in a solidly shaded area.

However, such an iron powder carrier has a true specific gravity as high as about 7.8, is too highly magnetized, and accordingly tends to produce a fusion bonding of a toner component to the surface of the iron powder carrier, which is a so-called toner spent, by being stirred/mixed with the toner particles in the developing box. When such toner spent occurs, the carrier decreases its effective surface area, and tends to decrease the capability of being charged due to friction with the toner particles.

On the other hand, in the case of a resin-coated iron powder carrier, the surface resin is peeled off by a stress during printing, and a core material (iron powder) is exposed which has high electroconductivity and low breakdown voltage. Thus, the resin-coated iron powder carrier may cause a leak of an electric charge. When such a leak of the electric charge occurs, an electrostatic latent image formed on the photoreceptor is damaged, forms a brush line or the like in a solidly shaded area, and hardly provides a uniform image. For these reasons, an iron powder carrier such as an oxide film iron powder and a resin-coated iron powder is not currently used.

In recent years, a ferrite carrier having a true specific gravity as small as about 5.0 and is also lowly magnetized has been used, as a carrier substituted for an iron powder carrier, or a resin-coated ferrite carrier of which the surface is coated with a resin has been used in many cases. As a result, the life of a developer has been drastically extended.

A general method for producing such a ferrite carrier includes the steps of: mixing predetermined amounts of raw materials for the ferrite carrier; calcinating the mixture, pulverizing the calcined mixture, graining the product and sintering the grains. The calcination step may be omitted according to conditions.

However, the method for producing the ferrite carrier has various problems. Specifically, the above produced ferrite particles are contaminated with deformed ferrite particles originating in cracked particles produced when having crushed a block formed in the sintering step, because the raw material is sintered generally in a form of being charged in a housing through a tunnel kiln in the sintering step which is a step of magnetizing the raw material through a ferritization reaction, and then the shape of the sintered raw material tends to be deformed due to interaction between particles and form the block, though the tendency is particularly more noticeable in ferrite particles with a smaller particle size. Besides, in order to produce the ferrite particles with small sizes and an adequate shape, it is necessary to employ a strengthened pulverization technique. Furthermore, the production method has a problem that the production stability is not sufficient, because the production method needs 12 hours of a sintering period of time including a heating-up period, a holding period at the maximum temperature and a cooling period, and needs to crush the formed block after the sintering step.

In addition, a carrier core material produced by such a sintering method contains not only the cracked particles but also a number of deformed particles, so that it is difficult to form a uniform coating film on such particles even when the particles are coated with a resin. The resin coating film tends to be thick in a recess, and be thin on a salient on the surface of the particle. A part having a thin coating film of the resin tends to expose the carrier core material in a short period of service due to the stress, which cause a leakage phenomenon and a spread of the distribution of a charge amount. Accordingly, it has been difficult to stabilize an image quality in a high grade for a long period of time.

In order to prevent cracking and cutting and reduce deformed particles, it is necessary to prevent the agglomeration of particles when the particles are sintered. It is possible to prevent the agglomeration and reduce the cracked particles and the deformed particles, by sintering the raw materials at a lower temperature because the crushing stress after sintering is lowered.

However, thus produced particle is not preferable in terms of its quality and a production cost, because the particle acquires a porous surface, is slowly charged due to an infiltrating resin, and increases an unnecessary amount of the resin due to the infiltration, which is not economical.

In order to solve such problems, a new method for producing a ferrite carrier has been proposed. For instance, Japanese Patent Laid-Open No. 62-50839 discloses a method for producing a ferrite carrier by passing a blend formed of metallic oxides which are raw materials for forming ferrite, through an atmosphere of high-temperature flames, thereby to instantly ferritize the blend.

However, in this production method the raw material of ferrite may be hardly baked depending on the type of the raw material, because a ratio of oxygen quantity to combustion gas quantity is 3 or less. The production method also is not suitable for producing ferrite with a small particle size of about 20 to 50 μm, which copes with a recent trend of using a carrier having a smaller diameter, and cannot provide a spherical and homogeneous ferrite particle.

In addition, Japanese Patent Laid-Open No. 3-233464 discloses a method for producing a carrier for an electrophotographic developer by melting a raw material of a carrier with a direct-current plasma technique, a high-frequency plasma technique or a hybrid plasma technique.

However, the production method employs expensive gases such as argon and helium, accordingly is extremely economically disadvantageous and is not practical.

As described above, such a method has not been found as to be able to produce a ferrite core material for electrophotography and a resin-coated ferrite carrier which have a high degree of fluidity, have little variation of magnetization intensity, are highly magnetized and are spherical, with excellent cost efficiency and high production stability.

DISCLOSURE OF THE INVENTION

Problems to be Solved by the Invention

Accordingly, an object of the present invention is to provide a method for producing a ferrite core material for electrophotography and a resin-coated ferrite carrier, which have a high degree of fluidity, and have little variation of magnetization intensity, are highly magnetized and are spherical, with excellent cost efficiency and high production stability.

Means for Solving the Problems

The present inventors made an extensive investigate for the purpose of solving the above described problems, as a result, found that the above described object can be achieved by adopting a production method of thermal-spraying a raw powder obtained by preparing raw materials for ferrite to ferritize the powder, subsequently rapidly solidifying the particle to form a core material of a ferrite carrier, and coating the surface with a resin to form a resin-coated ferrite carrier, and specifying the above described thermal spraying conditions, and arrived at the present invention.

Specifically, the present invention provides a method for producing the core material of the electrophotographic ferrite carrier, by charging the raw powder with an average particle size of 20 to 50 μm obtained by preparing the raw materials for ferrite into a combustion flame along with a carrier gas for the raw powder, thermal-spraying the powder in atmospheric air to ferritize the powder, subsequently rapidly solidifying the thermal-sprayed particle, and sampling and collecting the particle, wherein the method satisfies the conditions comprising the following (1) to (3):

(1) a mixture gas of propane and oxygen is used for the combustion flame for the thermal spraying, and a volumetric ratio of the propane to the oxygen is 1:3.5 to 6.0;

(2) the carrier gas for the raw powder is air, nitrogen, oxygen or a mixture gas thereof, and the ratio (a/b) of a charged amount (a) of the raw powder (kg/hr) to a charged amount (b) of the carrier gas (kg/hr) for the raw powder is 4.8 or less; and (3) a flame flow velocity of the combustion flame is 65 to 125 m/sec.

In the method for producing the core material of the electrophotographic ferrite carrier according to the present invention, the flow velocity of the raw powder is preferably 25 to 75 m/sec.

In the method for producing the core material of the electrophotographic ferrite carrier according to the present invention, the thermal-sprayed material is rapidly solidified in atmospheric air, and the solidified carrier particles are sampled and collected in atmospheric air.

In addition, in the method for producing the core material of the electrophotographic ferrite carrier according to the present invention, the thermal-sprayed material is rapidly solidified in water, and the solidified carrier particles may be sampled and collected in water. In this case, when the length of the combustion flame produced from the top of the burner is defined as 1, the water surface is desirably ¾ or more apart from the top of the burner.

Furthermore, the present invention provides a method for producing an electrophotographic carrier of resin-coated ferrite wherein the surface of a core material of the ferrite carrier is coated with a resin in the amount of 0.1 to 10 wt. % with respect to the weight of the core material of the ferrite carrier.

Advantage of the Invention

A method for producing a core material of an electrophotographic ferrite carrier and a resin-coated ferrite carrier according to the present invention is superior in production stability and cost efficiency, because the method can simplify a sintering step and can omit a crushing step. In addition, the obtained resin-coated ferrite carrier has excellent fluidity because of being substantially spherical, and besides has little variation of magnetization intensity and high resistance.

BEST MODE FOR CARRYING OUT THE INVENTION

Preferred embodiments according to the present invention will be now described below.

<Method for Producing Core Material of Electrophotographic Ferrite Carrier According to the Present Invention>

A method for producing a core material of an electrophotographic ferrite carrier according to the present invention will be now described.

The method for producing the core material of the electrophotographic ferrite carrier according to the present invention includes the steps of: charging the raw powder with an average particle size of 20 to 50 μm obtained by preparing the raw materials for the ferrite carrier into a combustion flame along with a carrier gas for the raw powder, thermal-spraying the powder in atmospheric air to ferritize the powder, subsequently rapidly solidifying the particle, and sampling and collecting the particle.

The method for preparing the raw powder having an average particle size of 20 to 50 μm with the use of the raw material for the ferrite carrier is not limited in particular; can adopt a conventionally well-known method; and may employ a dry process or a wet process.

An example of the method for preparing the raw powder includes the steps of: weighing out appropriate amounts of the raw materials for ferrite; adding water to the raw materials and grinding the mixture to produce a slurry; granulating the produced slurry with a spraying dryer; and classifying the obtained grains to prepare the grains (raw powder) with predetermined particle sizes. The particle sizes of the raw powder need to be 20 to 50 μm, in consideration of the particle size of the resin-coated ferrite carrier to be obtained. On the other hand, another example includes the steps of: weighing out appropriate amounts of the raw materials for ferrite; then mixing the raw materials; dry-pulverizing the mixture to disperse each raw material; granulating the mixture with a granulator; and classifying the obtained grains to prepare the grains (raw powder) with predetermined particle sizes.

In the present invention, it is preferable to select the raw material for ferrite so that the ferrite composition includes at least one element of Fe, Mn, Mg, Ca, Sr, Bi, Zr and Li.

Thus prepared raw powder is thermal-sprayed in atmospheric air to be ferritized. In the present invention, a method for producing a core material of a ferrite carrier having desired characteristics needs to satisfy the following conditions (1) to (3).

(1) A mixture gas of propane and oxygen is used for a combustion flame for the thermal spraying, and a volumetric ratio of the propane to the oxygen is 1:3.5 to 6.0. When the volumetric ratio is in the range, the raw powder is sufficiently melted to be completely ferritized. It is considered to use propylene or acetylene other than propane as a combustion gas, but in the present invention, propane is used in consideration of cost efficiency and operability. When the volumetric ratio of oxygen is less than 3.5 with respect to propane in the mixture gas, the mixture gas cannot give sufficient heat quantity to the raw powder, and cannot sufficiently melt the raw powder. On the other hand, when the volumetric ratio of oxygen exceeds 6.0, the mixture gas hardly ferritizes the raw powder and is uneconomical because oxygen is much more excessive than the complete combustion state of propane ($C_3H_5+5O_2 \rightarrow 3CO_2+4H_2O$). For instance, oxygen is blended in a ratio of 35 to 60 $Nm^3$/hr with respect to 10 $Nm^3$/hr of propane.

(2) A carrier gas for the raw powder is air, nitrogen, oxygen or a mixture gas thereof, and the ratio (a/b) of a charged amount (a) of a raw powder (kg/hr) to a charged amount (b) of the carrier gas (kg/hr) for the raw powder is 4.8 or less, and is preferably 4.5 or less. When the above described ratio (a/b) exceeds 4.8, the powder is not sufficiently dispersed in airflow and thermal-sprayed in a dense state, and accordingly the core material of the ferrite carrier to be obtained results in containing a number of deformed particles to show an awkward shape.

(3) A flow velocity of a combustion flame is 65 to 125 m/sec. When the flame flow velocity of the combustion flame is less than 65 m/sec, the combustion flame of a burner may cause a backfire, which is dangerous. On the other hand, when the flame flow velocity of the combustion flame exceeds 125 m/sec, the combustion flame blows off, which is dangerous, and besides, an excessive amount of the gas is consumed, which is uneconomical.

In the present invention, a flow velocity of a raw powder is preferably 25 to 75 m/sec. When the flow velocity of the raw powder is less than 25 m/sec, the combustion flame of a burner may cause a backfire, which is dangerous. On the other hand, when the flow velocity of the raw powder exceeds 75 m/sec, the raw powder is not sufficiently melted, the obtained powder contains many particles with an indeterminate shape, and besides, an excessive amount of the gas is consumed, which is uneconomical.

A raw powder is thermal-sprayed under the above described conditions, is ferritized and then is rapidly solidified. The raw powder is rapidly solidified in atmospheric air and the produced carrier particles are sampled and collected in the atmospheric air, or alternatively is rapidly solidified in water and the produced carrier particles are sampled and collected in the water. The method of sampling and collecting the produced carrier particles in water can collect the particles with higher efficiency.

When rapidly solidifying the melted particles in water, the water surface is preferably ¾ or more apart from the top of the burner, where the length of the burning flame produced from the top of the burner is defined as 1. When the distance is less than ¾, the magnetic properties are lowered.

Thus obtained particles are subsequently dried as needed, and are further classified. A classification method includes an existing air classification method, a mesh filtration method and a precipitation method. The particle size of dried particles is adjusted into a desirable particle size by using any of the above methods. When dry-collecting the classified particles, a cyclone can be used as well for collecting the particles.

A core material of a ferrite carrier can be obtained in such a manner. However, the surface electric resistance of the core material can be adjusted as needed, by heating the surface at a low temperature to form an oxide film thereon. The oxide film is formed by heat-treating the core material, for instance, at 300 to 700° C. by using a general rotary electric furnace or a batch electric furnace. The oxide film formed by the treatment has preferably a thickness of 0.1 nm to 5 μm. When the oxide film is thinner than 0.1 nm, the oxide film shows little effect of the oxide layer. On the other hand, when the oxide film is thicker than 5 μm, the core material shows lower magnetization intensity, acquires excessively high resistance, and consequently tends to cause a malfunction such as the decrease of developing capability. In addition, it is acceptable to reduce the core material prior to the oxidizing treatment, as needed.

<Method for Producing Electrophotographic Carrier of Resin-Coated Ferrite According to the Present Invention>

The surface of a core material of a ferrite carrier according to the present invention obtained with the above described method is coated with a resin. Thus, a resin-coated ferrite carrier is produced, which has a resin coating film formed thereon. An amount of the coated resin is 0.1 to 10 wt. % with respect to the core material of the carrier. When the amount of the coated resin is less than 0.1 wt. %, it is difficult to form a uniform coating layer on the carrier surface. On the other hand, when the amount exceeds 10 wt. %, the carriers aggregate with each other, which causes reduction in the productivity such as reduction in the yield, and causes the variation of developer characteristics such as fluidity and an amount to be charged in an actual machine.

The film-forming resin used here can be appropriately selected according to a type of a toner to be combined and an environment for use. The type is not limited in particular, but includes, for instance: a fluorine resin; an acryl resin; an epoxy resin; a polyamide resin; a polyamide-imide resin; a polyester resin; an unsaturated polyester resin; an urea resin; a melamine resin; an alkyd resin; a phenol resin; a fluorine acryl resin; an acryl-styrene resin; a silicone resin; and a modified silicone resin modified with the acryl resin, the polyester resin, the epoxy resin, the polyamide resin, the polyamide-imide resin, the alkyd resin, the urethane resin and a fluorine resin. When considering that the resin may be peeled off due to a mechanical stress in use, it is preferable to use a thermosetting resin. A specific thermosetting resin includes the epoxy resin, the phenol resin, the silicone resin, the unsaturated polyester resin, the urea resin, the melamine resin, the alkyd resin and a resin containing them.

The resin can be applied with a well-known method such as a brush coating method, a spray-dry method using a fluidized bed, a rotary dry method, and an immersion drying method with the use of a universal stirring machine. In order to increase a coverage factor, the method using the fluidized bed is preferable.

When baking after coating a core material of a carrier with a resin, a furnace to be used may be either of an external heating type or an internal heating type. For instance, a fixed-type or fluid-type electric furnace, a rotary electric furnace, or a burner furnace may be used, or the baking even by using a microwave can be used. When a UV-curable resin is employed, a UV heater is used. A baking temperature varies depending on a type of a resin to be used, but needs to be a melting point or a glass transition point or higher. When a thermosetting resin or a condensation cross-linking resin is employed, the resin needs to be heated-up to a temperature at which the resin is sufficiently cured.

A film-forming resin can include an electroconductive agent for the purpose of controlling an electric resistance, an electrostatic charge amount and an electrostatic charge speed of a carrier. The electroconductive agent itself has a low electric resistance, and accordingly tends to cause a rapid leak of electric charge when the electroconductive agent is excessively added. For this reason, the amount of the electroconductive agent to be added is 0.25 to 20.0 wt. % with respect to a solid content of the film-forming resin, preferably is 0.5 to 15.0 wt. %, and particularly preferably is 1.0 to 10.0 wt. %. The electroconductive agent includes: electroconductive carbon: an oxide such as titanium oxide and tin oxide; and various organic electroconductive agents.

In addition, the above described film-forming resin can contain a charge control agent. The charge control agent includes, for instance, various charge control agents to be generally used for a toner, and various silane coupling agents. This is because various charge control agents and silane coupling agents contained in the resin can control the charge properties of the carrier, when the formed film may have controlled an exposed area of a core material into a comparatively small area and consequently decreased electric-charge-imparting capability. A type of a usable charge control agent or coupling agent is not limited in particular, but preferably includes: a charge control agent such as nigrosine dye, a quarternary ammonium salt, an organometallic complex, a metal-containing mono azo dye; an aminosilane coupling agent; and a fluorinated silane coupling agent.

<Core Material of Ferrite Carrier Obtained in the Present Invention>

A core material of a ferrite carrier obtained in the present invention is substantially spherical. As the core material has such a shape, the ferrite carrier has excellent fluidity.

The spherical shape described here means the shape of which the average spherical rate (SF-1) is preferably 1.10 or less, further preferably is 1 to 1.10, and most preferably is a value unlimitedly close to 1. When the average spherical rate is higher than 1.10, spherical properties of a resin-coated ferrite carrier are deteriorated. The average spherical rate described here is measured with the following method.

Average spherical rate (SF-1): the average spherical rate (SF-1) was measured by the steps of: taking a photograph of many visual fields in which 100 or more particles in total can be counted, through an SEM with the magnification of 300 times, while changing the field; reading the photographed SEM image with a scanner; analyzing the image by using image analysis software "Image-Pro PLUS" (Media Cybernetics); determining a circumscribed circle diameter and an inscribed circle diameter of each particle; and calculating the ratio which was defined as a spherical rate. When the two diameters are equal, the ratio is 1, and when the shape of the carrier is a true sphere, the spherical rate is 1. The average calculated for 100 particles was determined to be an average spherical rate.

An apparent density of a core material of a ferrite carrier obtained in the present invention is preferably smaller than 2.80 g/cm$^3$, and further preferably is 2.55 to 2.80 g/cm$^3$. Such a core material as to have an apparent density of more than 2.80 g/cm$^3$ cannot be substantially produced. When the apparent density is smaller than 2.55 g/cm$^3$, it is considered that the sphericity of the core material obtained by the present production method is insufficient or the core material has a problem in the denseness of its inner part, which are not preferable. The apparent density described here is measured with the following method.

Apparent density: the apparent density is measured according to JIS-Z2504 (method for determining apparent density of metallic powder).

A fluidity of a core material of a ferrite carrier obtained in the present invention is preferably 30 s or lower, and further preferably is 28 s or lower. When the fluidity exceeds 30 s, the fluidity of ferrite carrier after having been coated with a resin also becomes inferior, and furthermore, when a developer is produced from the resin-coated ferrite carrier, the developer also does not acquire sufficient fluidity. Then, the developer does not smoothly increase a charge amount, and aggravates image characteristics. The fluidity described here is measured with the following method.

Fluidity: the fluidity was measured according to JIS-Z2502.

An average particle size of a core material of a ferrite carrier obtained in the present invention is preferably 20 to 50 μm. When the average particle size is less than 20 μm, the carrier tends to bond to each other, which is not preferable. When the average particle size exceeds 50 μm, the carrier tends to degrade an image, which is not preferable. The average particle size described here is determined by the following method.

Average particle size: the average particle size was measured with a laser diffraction scattering method. A used apparatus was a microtrack particle size analyzer (Model 9320-X100) made by Nikkiso Co., Ltd. A refractive index of the core material of the ferrite carrier was assumed to be 2.42. The average particle size was measured in the environment of 25±5° C. with a humidity of 55±15%. The average particle size (median size) described here means a cumulative 50% particle size in a volume distribution mode of particles under a sieve.

A carrier sample was dispersed in an aqueous solution of 0.2% sodium hexametaphosphate of a fluid dispersion, by ultrasonic-treating the dispersion for one minute with the use of an ultrasonic homogenizer (UH-3C) made by Ultrasonic Engineering Co., Ltd.

A core material of a ferrite carrier obtained in the present invention preferably has a magnetization intensity of 55 $Am^2$/kg or higher, and further preferably 55 to 95 $Am^2$/kg. When the magnetization intensity is less than 55 $Am^2$/kg, the carrier tends to bond to each other, which is not preferable. The magnetization intensity described here is measured with the following method.

Magnetic property: the magnetization intensity was measured by using an integral B-H tracer BHU-60 type (made by Riken Denshi Co., Ltd.). The magnetization intensity was measured by the steps of: inserting an H coil for measuring a magnetic field and a 4 πI coil for measuring magnetization intensity between electromagnets; placing a sample in the 4 πI coil, in this case; changing the magnetic field (H) by changing the electric current passing through the electromagnet; integrating each output of the H coil and the 4 πI coil; and drawing a hysteresis loop on a recording paper while determining the output (H) on the X-axis and the output of the 4 πI coil on the Y-axis. As for measurement conditions adopted here, an amount of a charged sample was about 1 g, a sample-charging cell had an inner diameter of 7 mmϕ±0.02 mm and a height of 10 mm±0.1 mm, and the 4 πI coil had the winding number of 30.

A scattering amount of a core material of a ferrite carrier obtained in the present invention is preferably 50 mg or smaller, and a magnetization intensity of a scattered material is preferably 45 $Am^2$/kg or more. When the scattering amount and the magnetization intensity of the scattered material are out of the range, the magnetization intensity of the core material is dispersed. The scattering amount and the magnetization intensity of the scattered material described here are measured by the following scattering test.

Scattering test: the scattering amount was determined by the steps of: magnetically retaining the core material of the carrier or a resin-coated carrier on a cylindrical sleeve having a region with a peak magnetic flux density of 70 mT in a direction perpendicular to an axis; opening only the magnetic pole area having the peak magnetic flux density; rotating the cylindrical sleeve for 30 minutes so as to applying three times gravity of a detaching force to the cylindrical sleeve in a direction perpendicular to the rotation axis; and measuring the amount of the core material or the resin-coated carrier that has been detached from the opening, which was defined to be the scattering amount. When the scattering amount is large, the carrier is assumed to be easily detached from a magnet roll while the carrier is actually used. Then, the scattered carrier results in damaging a photoreceptor or causes a white spot, which is inconvenient. The scattering amount is preferably 50 mg or smaller, further preferably is 30 mg or smaller, and particularly preferably is 10 mg or smaller. In addition, the magnetization intensity of the scattered material was determined by the same method as described above, and was defined as the scattered material magnetization intensity.

A resin-coated ferrite carrier obtained in the present invention is used together with a toner for an electrophotographic developer.

The present invention will be now described below with reference to examples.

Example 1

A mixture was prepared by the steps of: weighing out iron oxide, manganese oxide and magnesium oxide into a mole ratio of 50:40:10; adding 0.8 mol of strontium oxide to 100 mol of the total of those oxides; and mixing all the oxides. A slurry containing 50 wt. % of a solid was prepared by adding water to the above mixture, and grinding the mixture. A raw powder (granulated substance) with an average particle size of 30 μm was obtained by granulating the prepared slurry with a spraying dryer, and classifying the sprayed particles.

Subsequently, the obtained raw powder (granulated substance) was charged on conditions shown in Table 1 and was thermal-sprayed into water. Ferrite particles (core material of ferrite carrier) were produced by collecting quenched particles from the water, and drying the particles, and then classifying the dried particles. The characteristics of the core material of the ferrite carrier (average spherical rate, apparent density, fluidity, average particle size, magnetic properties, scattering amount, scattered material magnetization intensity and overall evaluation) are shown in Table 2. A method for evaluating these characteristics is described above.

The core material of the carrier was coated with the resin in a fluidized bed coating apparatus, after having dispersed 2 wt. % of the silicone resin SR-2411 (made by Dow Corning Toray Co., Ltd.) with respect to the core material and 3 wt. % of carbon black with respect to a solid content of the resin, into the core material. Thus coated resin was then baked at 240° C. for 3 hours. The resin-coated ferrite carrier was produced by screening the baked particles and magnetically selecting the screened particles.

Example 2

A core material of a ferrite carrier and a resin-coated ferrite carrier were obtained with the same method as in Example 1 except that thermal-spraying conditions were changed as shown in Table 1.

The characteristics of the core material of the ferrite carrier were measured with the same method as in Example 1, and the results are shown in Table 2.

Example 3

A core material of a ferrite carrier and a resin-coated ferrite carrier were obtained with the same method as in Example 1 except that thermal-spraying conditions were changed as shown in Table 1.

The characteristics of the core material of the ferrite carrier were measured with the same method as in Example 1, and the results are shown in Table 2.

Example 4

A core material of a ferrite carrier and a resin-coated ferrite carrier were obtained with the same method as in Example 1 except that thermal-spraying conditions were changed as shown in Table 1.

The characteristics of the core material of the ferrite carrier were measured with the same method as in Example 1, and the results are shown in Table 2.

Comparative Example 1

A core material of a ferrite carrier and a resin-coated ferrite carrier were obtained with the same method as in Example 1 except that thermal-spraying conditions were changed as shown in Table 1.

The characteristics of the core material of the ferrite carrier were measured with the same method as in Example 1, and the results are shown in Table 2.

Comparative Example 2

A core material of a ferrite carrier and a resin-coated ferrite carrier were obtained with the same method as in Example 1 except that thermal-spraying conditions were changed as shown in Table 1.

The characteristics of the core material of the ferrite carrier were measured with the same method as in Example 1, and the results are shown in Table 2.

Comparative Example 3

A core material of a ferrite carrier and a resin-coated ferrite carrier were obtained with the same method as in Example 1 except that thermal-spraying conditions were changed as shown in Table 1.

The characteristics of the core material of the ferrite carrier were measured with the same method as in Example 1, and the results are shown in Table 2.

TABLE 1

| Production condition | Propane flow rate ($Nm^3/h$) | Combustion oxygen flow rate ($Nm^3/h$) | Combustion ratio | Solid-gas ratio | Flame velocity m/sec | Powder velocity m/sec | Collecting method | Thermal spray distance in water mm | Powder-transporting gas flow rate ($Nm^3/h$) | Powder discharge rate Kg/h |
|---|---|---|---|---|---|---|---|---|---|---|
| Ex. 1 | 10 | 35 | 1:3.5 | 4.50 | 68.3 | 39.3 | In water | 1 | 8 | 45 |
| Ex. 2 | 9 | 45 | 1:5 | 2.56 | 81.9 | 73.7 | Atmospheric air | — | 15 | 48 |
| Ex. 3 | 10 | 50 | 1:5 | 3.00 | 91.0 | 39.3 | In water | ¾ | 8 | 30 |
| Ex. 4 | 15 | 65 | 1:5 | 2.40 | 121.4 | 49.1 | In water | 1 | 10 | 30 |
| Com. Ex. 1 | 10 | 30 | 1:3 | 4.00 | 60.7 | 29.5 | In water | 1 | 6 | 30 |
| Com. Ex. 2 | 8 | 28 | 1:3.5 | 1.50 | 54.6 | 78.6 | In water | 1 | 16 | 30 |
| Com. Ex. 3 | 10 | 50 | 1:5 | 5.00 | 91.0 | 39.3 | In water | ½ | 8 | 50 |

All the compositions: $MnO/MgO/Fe_2O_3/SrO$ = 40/10/50/0.8 mol %

TABLE 2

| Characteristics | Average spherical rate (SF-1) | Apparent density $g/cm^3$ | Fluidity s | Average particle size μm | Magnetic property $Am^2/kg$ | Amount of scattered substance mg | Scattered material magnetization intensity $Am^2/kg$ | Overall evaluation |
|---|---|---|---|---|---|---|---|---|
| Ex. 1 | 1.03 | 2.70 | 26.5 | 48 | 62 | 25 | 59 | Good |
| Ex. 2 | 1.02 | 2.55 | 29.8 | 33 | 61 | 13 | 60 | Good |
| Ex. 3 | 1.06 | 2.68 | 28.7 | 41 | 63 | 16 | 61 | Good |
| Ex. 4 | 1.05 | 2.62 | 27.5 | 29 | 60 | 17 | 58 | Good |
| Com. Ex. 1 | 1.21 | 2.04 | 53.0 | 38 | 40 | 95 | 26 | Poor |
| Com. Ex. 2 | 1.15 | 2.51 | 35.0 | 28 | 60 | 29 | 56 | Fair |
| Com. Ex. 3 | 1.06 | 2.50 | 25.7 | 34 | 47 | 103 | 39 | Poor |

* Magnetization intensity 1 KOe VSM

As is clear from the results shown in Table 2, core materials of a ferrite carrier obtained in Examples 1 to 4 are superior in sphericity and fluidity; and have a small amount of a scattered substance, little variation of magnetization intensity and are highly magnetized.

In contrast to this, the core material of a ferrite carrier obtained in Comparative example 1 is lowly magnetized and shows a large amount of a scattered substance. The core material of a ferrite carrier obtained in Comparative example 2 is inferior in fluidity. The core material of a ferrite carrier obtained in Comparative example 3 is lowly magnetized and shows a large amount of a scattered substance.

INDUSTRIAL APPLICABILITY

A method for producing a core material of an electrophotographic ferrite carrier and a resin-coated ferrite carrier according to the present invention is superior in production stability and cost efficiency, because the method can simplify a sintering step and can omit a crushing step. In addition, the obtained resin-coated ferrite carrier has excellent fluidity because of being substantially spherical, and besides has little variation of magnetization intensity and high resistance.

Accordingly, the production method according to the present invention is preferable as the method for producing the resin-coated ferrite carrier for an electrophotographic developer in an industrial scale. The electrophotographic developer which uses the obtained resin-coated ferrite carrier can give sufficient density to an image, can keep an image quality of high grade for a long period of time, and accordingly can be widely used in the fields of a full-color machine which is required to show high image quality, and of a high-speed machine which is required to show the reliability of keeping an image and durability in particular.

What is claimed is:

1. A method for producing a core material of an electrophotographic ferrite carrier, by charging a raw powder with an average particle size of 20 to 50 μm obtained by preparing raw materials for ferrite into a combustion flame along with a carrier gas for the raw powder, thermal-spraying the powder in atmospheric air to ferritize the powder, subsequently rapidly solidifying the thermal-sprayed particle, and sampling and collecting the particle, wherein the method satisfies the conditions comprising the following (1) to (3):

(1) a mixture gas of propane and oxygen is used for the combustion flame for the thermal spraying, and a volumetric ratio of the propane to the oxygen is 1:3.5 to 6.0;

(2) the carrier gas for the raw powder is air, nitrogen, oxygen or a mixture gas thereof, and the ratio (a/b) of a charged amount (a) of the raw powder (kg/hr) to a charged amount (b) of the carrier gas (kg/hr) for the raw powder is 4.8 or less; and (3) a flame flow velocity of the combustion flame is 65 to 125 m/sec.

2. The method for producing the core material of the electrophotographic ferrite carrier according to claim 1, wherein the flow velocity of the raw powder is 25 to 75 m/sec.

3. The method for producing the core material of the electrophotographic ferrite carrier according to claim 1, wherein the thermal-sprayed material is rapidly solidified in atmospheric air, and the solidified carrier particles are sampled and collected in atmospheric air.

4. The method for producing the core material of the electrophotographic ferrite carrier according to claim 1, wherein the thermal-sprayed material is rapidly solidified in water, and the solidified carrier particles are sampled and collected in water.

5. The method for producing the core material of the electrophotographic ferrite carrier according to claim 4, wherein the water surface is preferably ¾ or more apart from the top of the burner, when the length of the combustion flame produced from the top of the burner is defined as 1.

6. The method for producing the electrophotographic carrier of resin-coated ferrite according to claim 1, wherein the surface of the core material of the ferrite carrier is coated with a resin in the amount of 0.1 to 10 wt. % with respect to the weight of the core material of the ferrite carrier.

* * * * *